United States Patent [19]

Pezzulo et al.

[11] Patent Number: 4,990,366

[45] Date of Patent: Feb. 5, 1991

[54] METHOD FOR THE METALLIZATION OF A LUMINESCENT SCREEN

[75] Inventors: Antimo Pezzulo, Anagni; Himanshu Patel, Rome, both of Italy

[73] Assignee: Videocolor, Courbevoie, France

[21] Appl. No.: 258,677

[22] Filed: Oct. 17, 1988

[30] Foreign Application Priority Data

Oct. 20, 1987 [FR] France ..... 87 14431

[51] Int. Cl.[5] ..... B05D 5/12; B05D 5/06

[52] U.S. Cl. ..... 427/68; 427/64; 427/124; 427/226; 427/227

[58] Field of Search ..... 427/68, 123, 124, 226, 427/227, 64

[56] References Cited

U.S. PATENT DOCUMENTS

| | | | |
|---|---|---|---|
| 3,582,390 | 6/1971 | Saulnier | 427/68 |
| 4,339,475 | 7/1982 | Hinousugi et al. . | |

FOREIGN PATENT DOCUMENTS

| | | | |
|---|---|---|---|
| 1489237 | 2/1969 | Fed. Rep. of Germany . | |
| 1811763 | 7/1969 | Fed. Rep. of Germany . | |
| 54-105959 | 8/1979 | Japan | 427/68 |

*Primary Examiner*—Norman Morgenstern

*Assistant Examiner*—Margaret Bueker

*Attorney, Agent, or Firm*—Joseph S. Tripoli; Dennis H. Irlbeck; Vincent J. Coughlin, Jr.

[57] ABSTRACT

A method for the metallizing of a luminescent screen comprises the following steps:

the depositing of at least one luminophor coat, comprising at least one binder, on the inner face of the screen;

the depositing of a sub-layer, consisting of at least one aqueous emulsion of a water-insoluble film-forming resin;

the drying of the sub-layer and the heating of this screen to a temperature greater than the minimum temperature for the formation of the film;

the depositing of a finishing layer;

the drying of the finishing layer;

the depositing of a metallic coating on the finishing layer, and, the volatilizing of the binders of the luminiphor screen, the sub-layer and the finishing layer, wherein the sub-layer and the finishing layer are made from the same aqueous emulsions of water-insoluble film-forming resins, said emulsions having a film-forming temperature of below 45° C. and giving a continuous, thin, resistant, reflective and hydrophobic film.

6 Claims, No Drawings

METHOD FOR THE METALLIZATION OF A LUMINESCENT SCREEN

BACKGROUND OF THE INVENTION

1. Field of the Invention

The present invention concerns a method for the metallization of a luminescent screen. More particularly, it concerns a method for depositing an organic film, removable by heat, on the luminophors of a luminous screen used especially in color television tubes or color display monitors.

2. Description of the Prior Art

Luminescent screens are generally made by depositing, on the inner face of a glass face plate, small crystals of a cathodoluminescent body. These are called luminophors. To improve luminance particularly, the screen is moreover coated with a thin film of a metallic material, preferably aluminium. To make it possible to deposit the metal in the form of a continuous thin film, the luminophor grains are, first of all, coated with a removable film. This film is then destroyed by burning in air. Different materials can be used to make the film. Thus, as described in the U.S. Pat. No. 3,582,390, the film can be got from a resin-based aqueous emulsion so as to produce an organic substrate which is volatilized during subsequent burning. However, this type of emulsion gives a non-continuous film having holes, and the aluminium layer deposited on this film has low reflectivity. The luminance of the tube thus obtained is therefore weaker than is the case when other materials, notably solvent-based lacquers, are used to make the film. To overcome this drawback, the U.S. Pat. No. 3,579,367 has proposed a double layer method which reduces the luminance losses of the tube. However, in this method, two different acrylic emulsions are used, each having a particular TUKON hardness and a specific volatility. The use of two different precisely chosen emulsions is aimed at preventing any destruction or cracking of the aluminium film during subsequent burning. However, this method is costly and lengthy, and calls for highly sophisticated manufacturing systems when entirely automated production is desired.

SUMMARY OF THE INVENTION

An arm of the present invention, therefore, is to overcome the above-mentioned drawbacks, and an object of the invention is a method for the metallizing of a luminescent screen comprising the following steps:

- the depositing of at least one luminophor coat, comprising at least one binder on the inner face of the screen;
- the depositing of a sub-layer, consisting of at least one aqueous emulsion of water-insoluble film-forming resin;
- the drying of the sub-layer and the heating of this screen to a temperature greater than the minimum temperature for the formation of the film;
- the depositing of a finishing layer;
- the drying of the finishing layer;
- the depositing of a metallic coating on the finishing layer, and,
- the volatilizing of the binders of the luminiphor screen, the sub-layer and the finishing layer, wherein the sub-layer and the finishing layer are made from the same aqueous emulsions of water-insoluble film-forming resin, said emulsion having a film-forming temperature of below 45° C. and giving a continuous, thin, resistant, reflective and hydrophobic film.

Preferably, the resin forming a film is an acrylic resin. Furthermore, different types of emulsions can be used, notably acid-based emulsions, neutralized to a pH which is greater than or equal to 7.0, a mixture of acid-based and alkali-based emulsions, or an alkali-based emulsion acidified to a pH between 5.0 and 8.0. However, whatever the emulsions used, the final solution is homogenized to prevent partial gelling.

Furthermore, the acid-based emulsion is neutralized by at least one alkaline material such as ammonium hydroxide ($NH_4OH$) and the alkali-based emulsion is neutralized by at least one acid material such as acetic acid in order to reduce the temperature at which the resin film is formed.

Thus, it was noted that, by using an emulsion with specific characteristics, it was possible to use the same emulsion to make the sub-layer and the finishing layer, without getting breaks or cracks in the metallic film during the final burning needed to volatilize the binder, the sub-layer and the finishing layer.

DESCRIPTION OF A PREFERRED EMBODIMENT

A more detailed description is given below of an embodiment of the method for metallizing a luminescent screen according to the invention.

In the method for manufacturing a cathode tube, especially a color television tube, the particular structure of the luminescent screen is made before sealing this screen into the flared portion of the tube envelope. To make this structure, a glass face place forming a support is mounted in a suitable supporting device, and a slurry of suitable luminophor material is applied to this screen. The slurry consists of the desired luminophor, a suitable binder such as polyvinyl alcohol and a suitable photo-sensitizer such as ammonium dichromate or a similar product. The slurry is distributed throughout the surface of the face panel by tilting it and making it rotate. Then the slurry is dried. The slurry layer thus obtained is then exposed to suitable light rays through a mask to record the pattern of dots of a color. After this exposure, the exposed portions of the slurry are copolymerized and become insoluble in water. The unexposed portions of the slurry layer can then be removed by simple washing, and the water leaves the pattern of dots. This general procedure is repeated to deposit the other two colors in the case of a three-color type of tube.

When the depositing of the luminophor screen is over, the face panel is held in the supporting device to deposit two layers of acrylic resin according to the present invention. The supporting device can rotate at variable rotational speeds between 6 and 200 rpm. The face panel provided with its luminophor screen is rotated in a vertical position at a speed of 20 to 60 rpm. At this moment, a quantity of 200 to 500 ml of an aqueous resin emulsion, designed to make a sub-layer, according to the present invention, is spread on the luminophor layer of the screen. The screen is then rotated at high speed, between 60 and 200 rpm, for 5 to 30 seconds, to remove excess material. The screen is heated during and after the rotation at high speed to form a film quickly. Then the screen is made to rotate at a speed between 20 and 100 rpm in a vertical position and is dried by radiant heat. This heat is obtained, for example, from infra-red lamps. When the first film has been dried, an aqueous resin based emulsion, having the same basic composition as the first film, is spread on the screen in the same way as with the first film. During the depositing operation, the temperature is kept at a temperature equivalent to or greater than the minimum temperature for the formation of the film from the emulsion. The excess emulsion is removed by rotation at a speed between 100 and 200 rpm for 5 to 30 seconds. The screen is then heated by radiant heat during and after the rotation. The heat source has high power so that the film forming the finishing layer is formed quickly. Then, when the drying of the panel is completed, a solution containing 1 to 3% of a constituent element such as oxalic acid , or ammonium oxalate, or a colloidal silica marketed under the brand name LUDOX or boric acid is sprayed on the incurvated surface of the screen and on the skirt extending this surface. This spray gives a porous substrate such that, at the level of the sprayed surfaces, the metal forms no blisters during the burning cycle. The screen is then placed on metallization apparatus. A thin film of metal, preferably aluminium, is deposited by vacuum evaporation on the substrate. This film has a thickness between 1000 and 5000 angstroms. The screen is removed from the metallization apparatus and subjected to burning in air at a temperature of about 420° C. At this temperature, the binder deposited with the luminophor material as well as the sub-layer and the finishing layer are removed by evaporation. Then, the assembling of the screen in the cathode ray tube is completed in the usual way.

In the above method, the emulsion used to make the film of the sub-layer or the finishing layer is an aqueous emulsion of a water-insoluble film-forming resin with the following properties:

- a relatively low film-forming temperature, namely below 45° C.,
- a capacity to form a thin, continuous, reflective and hydrophobic film on the luminophor screen.

In general, water-insoluble resins forming films are acrylic resins. Furthermore, the emulsions used may be of different types. Thus, the emulsion may be an acid-based emulsion neutralized to a pH greater than or equal to 7.0. In this case, the neutralizing is done by at least one alkaline material such as ammonium hydroxide ($NH_4OH$) in order to reduce the film-forming temperature of the resin. The emulsion may be a mixture of acid-based and alkali-based emulsions. Finally, the emulsion may be alkali-based, acidified to a pH between 5.0 and 8.0. In this case, the alkali-based emulsion is neutralized by at least one acid material such as acetic acid in order to reduce the film forming temperature of the resin. With the above-described emulsions, homogenization is needed to prevent gelling. For, gelling causes non-uniformity in the structure of the layers of the screen while homogeneity returns the colloidal resin to a state of suspension, thus making it possible to obtain uniform layers A description shall be given below of various formulations of aqueous emulsions used to make the sub-layer and the finishing layer in the method of the present invention. These formulations can be prepared with the following solutions:

SOLUTION A: the emulsion is an aqueous emulsion containing about 46% of an acrylate resin copolymer emulsified in water and having a pH between 9 to 10. The term "acrylate resin copolymers" designates copolymers consisting of a combination of alkyd acrylates, alkyd methacrylates, acrylic acid, methacrylic acid and similar acrylate type monomers. An known emulsion of this type is that marketed under the brand name RHOPLEX AC-73 by the ROHM and HAAS Co., Philadelphia PA.

SOLUTION B: this is aqueous emulsion containing about 38% of an acrylate resin copolymer emulsified in water with a pH of about 3.0. An emulsion of this type is, for example, the emulsion marketed under the brand name RHOPLEX B-74 by the firm ROHM and HAAS Co., Philadelphia PA.

SOLUTION C: an aqueous solution with 30% of ammonium hydroxide ($NH_4OH$).

EXAMPLE 1

13.0% of RHOPLEX AC-73.

The film-forming emulsion used both to make the film of the sub-layer and the film of the finishing layer was obtained as follows. A quantity of 283 g. of solution A was mixed with 717 g. of de-ionized water. Then this solution was mixed in a rotary mixer for two hours.

This emulsion was deposited on the screen as indicated above.

EXAMPLE 2

11.0% of RHOPLEX B-74, pH 7-9.

An film-forming emulsion used for the sub-layer and the finishing layer was obtained as follows. A quantity of 289 g. of solution B was mixed with 711 g. of de-ionized water. The solution was stirred in a rotary mixer and solution C was added to adjust the pH to a value greater than 7.0 but smaller than 9.5. Then the solution was mixed at high speed in a high-speed homogenizer for one hour. (the homogenizer consisted of the kinematic model PT-35 2 ODM). The stirring was stopped to remove the bubbles and the solution could be used after two hours.

EXAMPLE 3

6.0% of RHOPLEX AC-73, 6.0% of RHOPLEX B-74, pH 7-9 (total solid 12%).

A film-forming emulsion, used for the sub-layer and the finishing layer, containing 6.0% of RHOPLEX AC-73, 6.0% of RHOPLEX B-74, with a pH between 7 and 9, was obtained as follows. A mixture was made of 130 g. of solution A and 158 g. of solution B with 712 g. of de-ionized water. Then the solution C was added to adjust the pH to a value greater than 7.0 and smaller than 9.5. The solution was mixed at high speed in a high-speed homogenizer for one hour. Then the stirring was stopped to remove the bubbles, and the solution could be used after two hours.

The above examples use two different solutions marketed by the firm ROHMS and HAAS Co., Philadephia, U.S.A. Other emulsions, such as the emulsion RHOPLEX B-85, by ROHMS and HAAS Co. can also be used if they give the film quality and film-forming properties described above.

The main solid constituent elements of the aqueous emulsions which can be used in the present invention are film-forming resins which are insoluble in water and are volatilized by heating at temperatures of up to 450° C. The film should be relatively hard, continuous, thin, reflective and hydrophobic. The film-forming temperature should be below 45° C. to facilitate mass production. The manufacture of the first and second films, forming the sub-layer and the finishing layer, is simplified because the same basic solution is used for both films. This reduces the amount of equipment used to make the mixture as well as the conduits needed for mass production. Similarly, the checking of the main parameters of the film is simplified.

In this case, first film forms a the hydrophobic substrate, after drying, so that when the second film is applied, the penetration of the film in the luminophor structure is reduced to the minimum and a continuous, reflecting and thin film which follows the luminophor dots is obtained. Thus, when the metal, which is preferably aluminium, is deposited during the following step of the method, an improvement is obtained in the quality of the mirror behind the luminophor screen. This therefore gives tubes with very high-quality luminescence.

What is claimed is:

1. A method for metallizing a luminescent screen, comprising the steps of:

depositing at least one luminophor coat containing at least one binder on the inner face of a panel to form a luminescent screen;

depositing a sub-layer consisting of at least one aqueous emulsion of an acrylic film-forming resin on the screen;

drying said sub-layer by heating the screen to a temperature sufficient to form a first film that is relatively hard, continuous, thin, reflective and hydrophobic;

maintaining the temperature of the screen at a temperature equivalent to or greater than the minimum temperature for the formation of a second film while depositing a finishing layer on the first film from the same aqueous emulsion of acrylic film-forming resin having a film-forming temperature of below 45° C. which is the same aqueous from which the first film is formed;

drying the finishing layer to form the second film having properties identical to those of the first film;

depositing a metallic coating on the dried second film; and volatilizing the binder of the luminophor screen, the first film and the second film.

2. A method according to claim 1, wherein the emulsion is acid-based, neutralized to a pH greater than or equal to 7.0, the final solution being homogenized to prevent a partial gelling.

3. A method according to claim 1, wherein the emulsion is a mixture of acid-based and alkali-based emulsions, the final solution being homogenized to prevent a partial gelling.

4. A method according to claim 1, wherein the emulsion is alkali-based, acidified to a pH between 5.0 and 8.0, the final solution being homogenized to prevent partial gelling.

5. A method according to claim 2, wherein the acid-based emulsion is neutralized by at least one alkaline material such as ammonium hydroxide ($NH_4OH$) in order to reduce the film-forming temperature of the resin.

6. A method according to claim 4, wherein the alkaline-based emulsion is neutralized by at least one acid material such as acetic acid in order to reduce the film-forming temperature of the resin.

* * * * *